US007277078B2

(12) United States Patent
Sato et al.

(10) Patent No.: US 7,277,078 B2
(45) Date of Patent: Oct. 2, 2007

(54) DISPLAY DEVICE

(75) Inventors: Hideo Sato, Hitachi (JP); Tomohiko Sato, Fujisawa (JP); Norio Mamba, Kawasaki (JP); Masahiro Maki, Mobara (JP); Takayuki Nakao, Mobara (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 499 days.

(21) Appl. No.: 10/743,736

(22) Filed: Dec. 24, 2003

(65) Prior Publication Data

US 2004/0135778 A1 Jul. 15, 2004

(30) Foreign Application Priority Data

Dec. 26, 2002 (JP) ..... 2002-377197

(51) Int. Cl.
*G09G 3/36* (2006.01)

(52) U.S. Cl. ..... 345/100; 345/94

(58) Field of Classification Search ..... 345/87, 345/94, 95, 98–100, 204
See application file for complete search history.

(56) References Cited

U.S. PATENT DOCUMENTS 5,477,234 A * 12/1995 Suzuki et al. ..... 345/95
5,670,979 A 9/1997 Hug et al.
6,307,681 B1 * 10/2001 Aoki et al. ..... 359/645
6,384,806 B1 5/2002 Matsueda et al.
6,384,817 B1 * 5/2002 Janssen et al. ..... 345/204
6,429,858 B1 * 8/2002 Janssen et al. ..... 345/204
6,956,549 B2 * 10/2005 Naiki ..... 345/87
2001/0040548 A1 * 11/2001 Ikeda ..... 345/92

FOREIGN PATENT DOCUMENTS

JP 05143022 * 11/1993
JP 6-178238 6/1994
JP 11-272242 10/1999

* cited by examiner

*Primary Examiner*—Amr A. Awad
*Assistant Examiner*—Tom V Sheng
(74) *Attorney, Agent, or Firm*—Antonelli, Terry, Stout & Kraus, LLP.

(57) ABSTRACT

A display device, which is capable of performing gamma correction of a video signal voltage applied to respective pixels, includes a drive circuit which supplies a video signal voltage to a plurality of video signal lines. The drive circuit includes a storage circuit which stores display data inputted from the outside, a reference data generating circuit which generates reference data, a ramp voltage generating circuit, a plurality of comparing circuits which compare display data stored in the storage circuit and reference data generated by the reference data generating circuit, and a plurality of sampling circuits which sample the ramp voltage based on a result of comparison by the comparing circuit and which output the sampled ramp voltage as a video signal voltage to respective video signal lines, wherein the reference data generated by the reference data generating circuit is changed non-linearly with respect to time.

8 Claims, 10 Drawing Sheets

| Nc | fin |
|---|---|
| Nc≦N1 | f4 |
| N1<Nc≦N2 | f3 |
| N2<Nc≦N3 | f2 |
| N3<Nc≦N4 | f1 |
| N4<Nc≦N5 | f2 |
| N5<Nc≦N6 | f3 |
| N6<Nc | f4 |

| a2 | a1 | a0 | c | | | | | | | |
|---|---|---|---|---|---|---|---|---|---|---|
| | | | b=000 | b=001 | b=010 | b=011 | b=100 | b=101 | b=110 | b=111 |
| 0 | 0 | 0 | 1 | 0 | 0 | 0 | 0 | 0 | 0 | 0 |
| 0 | 0 | 1 | 1 | 1 | 0 | 0 | 0 | 0 | 0 | 0 |
| 0 | 1 | 0 | 1 | 0 | 1 | 0 | 0 | 0 | 0 | 0 |
| 0 | 1 | 1 | 1 | 1 | 1 | 1 | 0 | 0 | 0 | 0 |
| 1 | 0 | 0 | 1 | 0 | 0 | 0 | 1 | 0 | 0 | 0 |
| 1 | 0 | 1 | 1 | 1 | 0 | 0 | 1 | 1 | 0 | 0 |
| 1 | 1 | 0 | 1 | 0 | 1 | 0 | 1 | 0 | 1 | 0 |
| 1 | 1 | 1 | 1 | 1 | 1 | 1 | 1 | 1 | 1 | 1 |

DISPLAY DEVICE

BACKGROUND OF THE INVENTION

The present invention relates to a display device, and, more particularly, to a technique which is applicable to gamma correction of a video signal voltage that is applied to respective pixels in a display device.

A liquid crystal display module of a TFT (Thin Film Transistor) type has been used extensively as a display device in a notebook type personal computer or the like.

As an example of a liquid crystal display module, a display module in which thin film transistors (TFT) are mounted on a polysilicon layer (hereinafter referred to as polysilicon type liquid crystal display module) has been known.

Further, as such a liquid crystal display module, there is a display module that employs a method (hereinafter referred to as a PWM method) in which display data within one horizontal scanning line period is stored, and reference data which is sequentially increased or decreased within one horizontal scanning line period is generated; the stored display data and the reference data are compared to each other; and, when these data coincide with each other, a video signal voltage generated by a video signal voltage generating circuit is sampled and is applied to respective pixels (see Japanese Unexamined Patent Publication Hei 6 (1994)-178238 (hereinafter referred to as patent literature 1), Japanese Unexamined Patent Publication Hei 11 (1999)-272242 (hereinafter referred to as patent literature 2)).

As the video signal voltage generated by the above-mentioned video signal voltage generating circuit, a voltage having an inclined voltage waveform (hereinafter referred to as a ramp voltage) is used.

SUMMARY OF THE INVENTION

As described in the above-mentioned patent literature 1, with respect to the video signal voltage that is applied to each pixel, it is necessary to perform gamma correction by taking a transmissivity curve of the liquid crystal into consideration. In the liquid crystal display device described in the above-mentioned patent literature 1 and patent literature 2, gamma correction is performed by a video signal voltage generating circuit.

FIG. 18 is a diagram showing one example of the conventional gamma correction technique disclosed in FIG. 7 of the above-mentioned patent literature 1 or in FIG. 14 of the above-mentioned patent literature 2. As can be understood from these drawings, in the gamma correction method described in the above-mentioned patent literature 1 and patent literature 2, an output of a ramp generating circuit is modulated in conformity with the required gamma characteristics.

To be more specific, in accordance with this method, is a method in which the gamma characteristics are stored in a memory (MM) in advance, values of the memory (MM) are sequentially read out, and there values are converted into an analogue voltage using a digital/analogue converter (DAC). In FIG. 18, reference symbol AMP indicates an amplifier which amplifies the analogue voltage obtained by signal conversion in the digital/analogue converter (DAC), and a reference symbol RAMP indicates a ramp voltage outputted from the amplifier (AMP).

However, in implementing the above-mentioned methods, it is necessary to provide a digital/analogue converter having a high resolution, such that the circuit scale of the digital/analogue converter having such high resolution becomes large-sized, and an extremely high accuracy is required, thus giving rise to the problem that it is difficult to form the digital/analogue converter on a substrate on which a display panel is formed.

Further, although the output of the ramp generating circuit is delayed due to the wiring capacitance of the video signal lines (drain lines) in the display panel, the voltage error caused by this delay depends on the inclination of the ramp voltage with respect to time.

In performing gamma correction, the inclination differs in respective regions, and the maximum inclination assumes a large value. Accordingly, there arises a drawback in that the error is increased, and, at the same time, the amount of error differs among the regions.

The present invention has been made to solve the above-mentioned drawbacks of the related art, and it is an object of the present invention to provide a display device which is capable of performing gamma correction of a video signal voltage that is applied to respective pixels without modulating a ramp voltage.

The above-mentioned and other objects and novel features of the present invention will become apparent from the following description in this specification and the attached drawings.

A summary of representative aspects of the invention disclosed in this specification is as follows.

The present invention is directed to a display device which includes a display part having a plurality of pixels, a plurality of video signal lines which apply a video signal voltage to the plurality of pixels, and a drive circuit which supplies the video signal voltage to the plurality of video signal lines. The drive circuit includes a storage circuit which stores display data inputted from the outside, a reference data generating circuit which generates reference data, a ramp voltage generating circuit which generates a ramp voltage, a plurality of comparing circuits which compare the display data stored in the storage circuit and the reference data generated by the reference data generating circuit, and a plurality of sampling circuits which sample the ramp voltage generated by the ramp voltage generating circuit based on a result of comparison of the comparing circuit. The sampled ramp voltage is output as a video signal voltage to respective video signal lines, wherein the reference data generated by the reference data generating circuit is changed non-linearly with respect to time.

Here, the above-mentioned reference data generating circuit, includes a selection circuit to which a plurality of clocks which have different frequencies from each other are inputted, and which selects one clock out of the plurality of clocks in response to a selection control signal; a counter which counts clocks selected by the selection circuit and outputs the number of counts as reference data; and a control part which transmits the selection control signal, which indicates the clocks to be selected by the selection circuit in response to a preset number of counts and the number of counts of the counter, to the selection circuit.

Further, the control part includes a plurality of registers which store a preset number, a plurality of comparators which compare the number stored in respective registers and the number of counts of the counter, and a control circuit which generates the selection control signals in response to the result of a comparison at the plurality of comparators.

Further, in accordance with the present invention, the ramp voltage generating circuit generates a ramp voltage of positive polarity and a ramp voltage of negative polarity, and the sampling circuit samples the ramp voltage of positive polarity or the ramp voltage of negative polarity generated by the ramp voltage generating circuit in response to an alternating signal inputted from the outside and the result of comparison of the comparing circuits and outputs the sampled ramp voltage to respective video signal lines as a video signal voltage.

Further, according to the present invention, the ramp voltage generating circuit generates the ramp voltage of positive polarity and the ramp voltage of negative polarity, and the sampling circuit includes a first sampling circuit, which samples the ramp voltage of positive polarity generated by the ramp voltage generating circuit in response to an inputted result of comparison of one comparing circuit out of two comparing circuits; a second sampling circuit, which samples the ramp voltage of negative polarity generated by the ramp voltage generating circuit in response to an inputted result of comparison of another comparing circuit out of two comparing circuits; a first switching circuit, which inputs the inputted result of comparison of one comparing circuit out of two comparing circuits to either the first sampling circuit or the second sampling circuit and the inputted result of comparison of another comparing circuit out of two comparing circuits into either the second sampling circuit or the first sampling circuit in response to an alternating signal inputted from the outside; and a second switching circuit, which outputs the ramp voltage of positive polarity sampled by the first sampling circuit to one video signal line or another video signal line out of neighboring video signal lines as a video signal voltage, or outputs the ramp voltage of negative polarity which is sampled by the second sampling circuit to another video signal line or one video signal line out of the neighboring video signal lines as a video signal voltage in synchronism with the changeover at the first switching circuit and in response to the alternating signal.

DESCRIPTION OF THE PREFERRED EMBODIMENTS

Hereinafter, embodiments of the present invention will be explained in detail in conjunction with the drawings. In all of drawings, parts having the same functions are indicated by the same symbols, and their repeated explanation is omitted.

Embodiment 1

Figure 1:
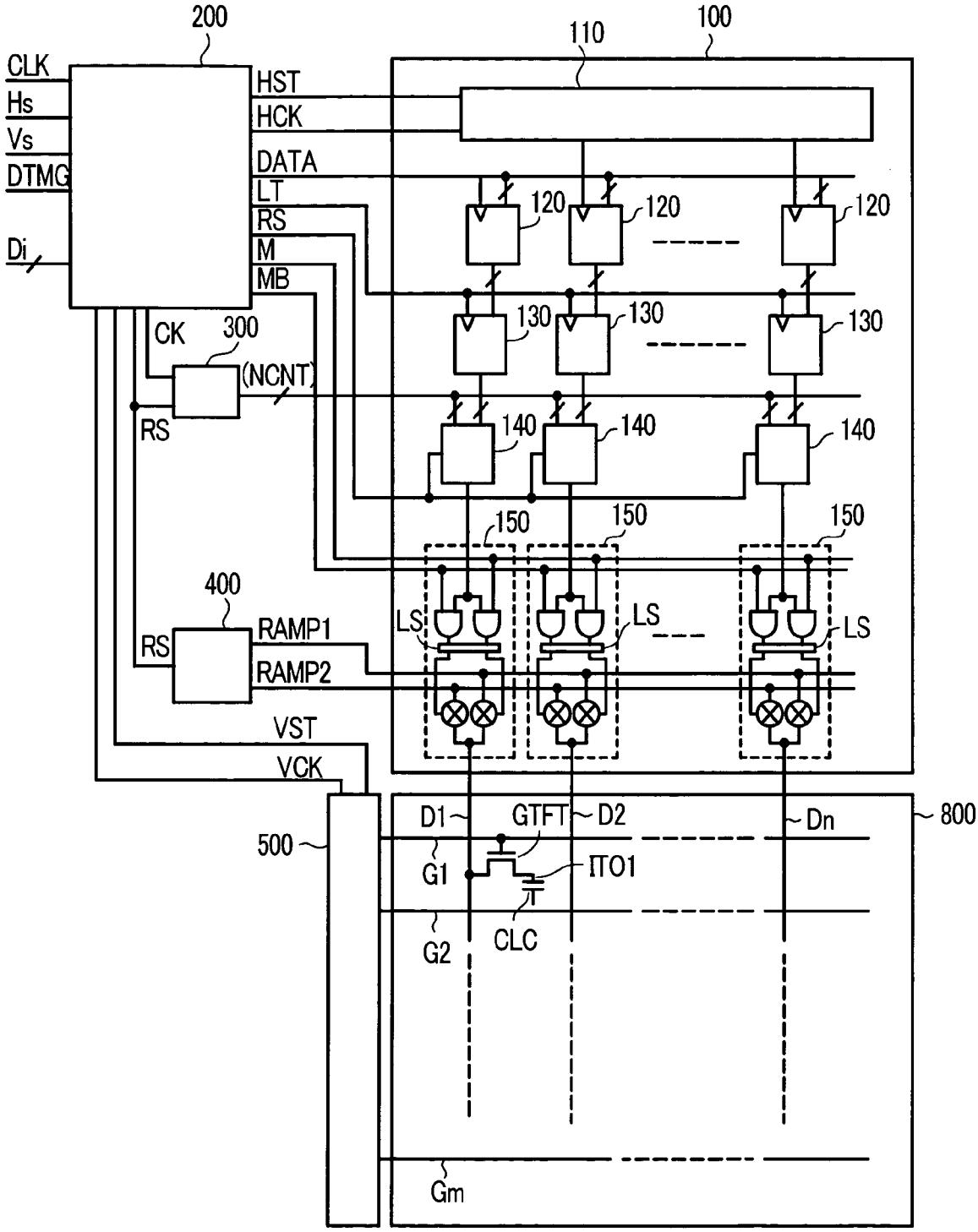
FIG. 1 is a schematic diagram showing the constitution of a liquid crystal display device according to an embodiment 1 of the present invention.

FIG. 1 is a diagram showing a liquid crystal display device according to an embodiment of the present invention. The liquid crystal display device of this embodiment is a polysilicon type liquid crystal display module in which thin film transistors (TFT) are formed on a polysilicon layer.

The liquid crystal display device of this embodiment includes a drain driver 100, a timing control circuit 200, a reference data generating circuit 300, a ramp voltage generating circuit 400, a gate driver 500 and a display part 800.

In the display part 800, there are a plurality of pixels, which are arranged in a matrix array, drain signal lines D, which supply a video signal voltage to respective pixels, and gate signal lines G, which supply a scanning signal voltage to the respective pixels.

Each pixel includes a pixel transistor (GTFT), which is constituted of a thin film transistor, and the pixel transistor (GTFT) is connected between a drain signal line D and a pixel electrode (ITO1), and a gate thereof is connected to a gate signal line G. Between the pixel electrode (ITO1) and a counter electrode (also referred to as a "common electrode", although not shown in the drawing), liquid crystal is sealed, and, hence, a pixel capacity (CLC) is equivalently connected between the pixel electrode (ITO1) and the counter electrode. In FIG. 1, for the sake of brevity of illustration, only one thin film transistor (GTFT) is shown.

The drain driver 100 is constituted of a shift register 110, a latch circuit 120, a latch circuit 130, a comparator 140 and a sample holding circuit 150.

The timing control circuit 200 receives a clock (CLK), a horizontal synchronous signal (Hs), a vertical synchronous signal (Vs), a display timing signal (DTMG) and display data (Di) as input signals, and it generates signals which control the drain driver 100, the reference data generating circuit 300, the ramp voltage generating circuit 400 and the gate driver 500.

Hereinafter, the driving method employed in the liquid crystal display device of this embodiment will be explained.

In general, for the purpose of preventing degradation of the liquid crystal, a liquid crystal display device typically adopts an alternating driving method. In the liquid crystal display device of this embodiment, as an alternating driving method, a dot inversion method is adopted. According to the dot inversion method, video signals which are applied to pixels which are arranged close to each other assume polarities opposite to each other in the row direction as well as in the column direction.

The shift register 110 is operated in response to a start signal (HST) and a clock signal (HCK) transmitted from the timing control circuit 200, and it outputs a multi-phase pulse which controls the latch circuits 120.

The latch circuits 120, in response to this multi-phase pulse, sequentially hold the display data (DATA) transmitted from the timing control circuit 200, one after another, for one horizontal scanning line.

Upon receipt of a timing signal (LT), which is indicative of the completion of transfer of display data for one horizontal scanning line, from the timing control circuit 200, the latch circuit 130 receives and holds the display data in the latch circuit 120 at the same timing and at the same time.

The comparator 140 compares a quantity of display data held by the latch circuit 130 and a quantity of reference data (NCNT) transmitted from the reference data generating circuit 300. To be more specific, the comparator 140 is initialized in response to an initializing signal (RS) transmitted from the timing control circuit 200, and, thereafter, it outputs a High level (hereinafter referred to as "H level") when the reference data (NCNT) is smaller than the display data or equal to the display data. The reference data generating circuit 300 is an up counter which receives the clock (CK) and the initializing signal (RS) transmitted from the timing control circuit 200 as inputs. The sample holding circuit 150 receives an output of the comparator 140, the alternating signals (M, MB), and outputs (RAMP1, RAMP2) of the ramp voltage generating circuit 400 as inputs, and it outputs a video signal voltage to the drain signal lines D on the display part 800. Here, the alternating signal (M) and the alternating signal (MB) are logic signals which control the polarity of the video signal voltage that is applied to the pixel electrode of the display part 800 and have the relationship of inversion, and, hence, their logics are inverted for every line or for every frame.

The output (RAMP1) of the ramp voltage generating circuit 400 is a ramp voltage of positive polarity, and the output (RAMP2) of the ramp voltage generating circuit 400 is a ramp voltage of negative polarity. With respect to respective ramp voltages (RAMP1) and (RAMP2), their absolute values of inclination are set to be equal to each other.

The sample holding circuit 150 samples a ramp voltage (RAMP1) using the switching element (SWA) or a ramp voltage (RAMP2) using the switching element (SWB) in response to an output signal of the comparator 140 under the control of alternating signals (M, MB) and outputs the sampled voltage to the drain signal lines (D) as video signal voltages.

In the case shown in FIG. 1, when the alternating signal (M) assumes the H level and the alternating signal (MB) assumes the L level, the sampled ramp voltage (RAMP1) of positive polarity is outputted to the drain lines (D1) and the sampled ramp voltage (RAMP2) of negative polarity is outputted to the drain lines (D2). Further, when the alternating signal (M) assumes the L level and the alternating signal (MB) assumes the H level, the sampled ramp voltage (RAMP2) of negative polarity is outputted to the drain lines (D1) and the sampled ramp voltage (RAMP1) of positive polarity is outputted to the drain lines (D2). Due to such a constitution, the polarity of the video signal outputted to the drain lines D can be inverted for every one horizontal line between neighboring drain signal lines. In FIG. 1, reference symbol LS indicates a level shift circuit.

The gate driver 500 is operated in response to a start signal (VST) and a clock (VCK) transmitted from the timing control circuit 200, and it outputs a scanning signal which sequentially turns on pixel transistors (GTFT) for one horizontal scanning line period to the gate signal lines G of the display part 800.

In this way, images are displayed on the display part 800. In this embodiment, since the alternating operation is performed by the sample holding circuit 150, the ramp voltages (RAMP1, RAMP2) which are outputted from the ramp voltage generating circuit 400 can be held at the positive polarity and the negative polarity without changing the polarity, whereby the voltage amplitude can be decreased and the power consumption can be reduced. Further, the output impedance of the ramp generating circuit 400 can be reduced, and, hence, the delay time can be shortened, whereby the display images of high quality can be obtained.

Figure 2:
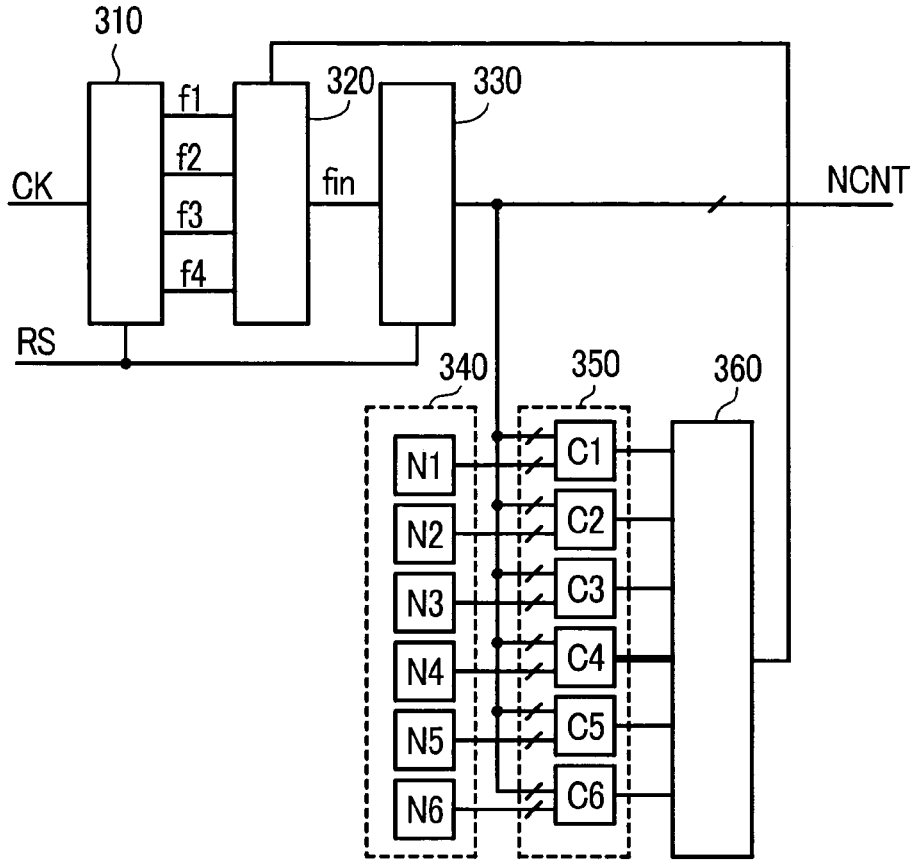
FIG. 2 is a block diagram showing an example of the reference data generating circuit shown in FIG. 1.

In this embodiment, gamma correction is performed using the reference data generating circuit 300. FIG. 2 is a block diagram showing the reference data generating circuit 300 shown in FIG. 1.

The reference data generating circuit 300 is constituted of a frequency dividing circuit 310, a selector 320, a counter 330, a register 340, a comparator 350 and a control circuit 360.

The frequency dividing circuit 310 divides the frequency of the input clock CK and outputs four divided frequency signals (f1, f2, f3, f4). Here, in FIG. 2, RS indicates an initializing signal. The frequencies of the respective outputs of the frequency dividing circuit 310, when f0 is set as the reference frequency, become f1/f0=1, f2/f0=1/2, f3/f0=¼, f4/f0=1/8.

The selector 320, in response to an output signal of the control circuit 360, selects one signal (input signal (fin)) from the four divided frequency signals (f1, f2, f3, f4) outputted from the frequency circuit 310 and outputs the input signal (fin) to the counter 330. The counter 330 is an up counter which counts the input signal (fin).

In the register 340, data for gamma correction (N1 to N6) is preliminarily stored. In this embodiment, the data is stored at six points. The comparator 350 compares an output value of the counter 330 and a value of the gamma correction data stored in the register 340. The control circuit 360 receives an output of the comparator 350 as an input and controls the selector 320.

Figures 4, 5:
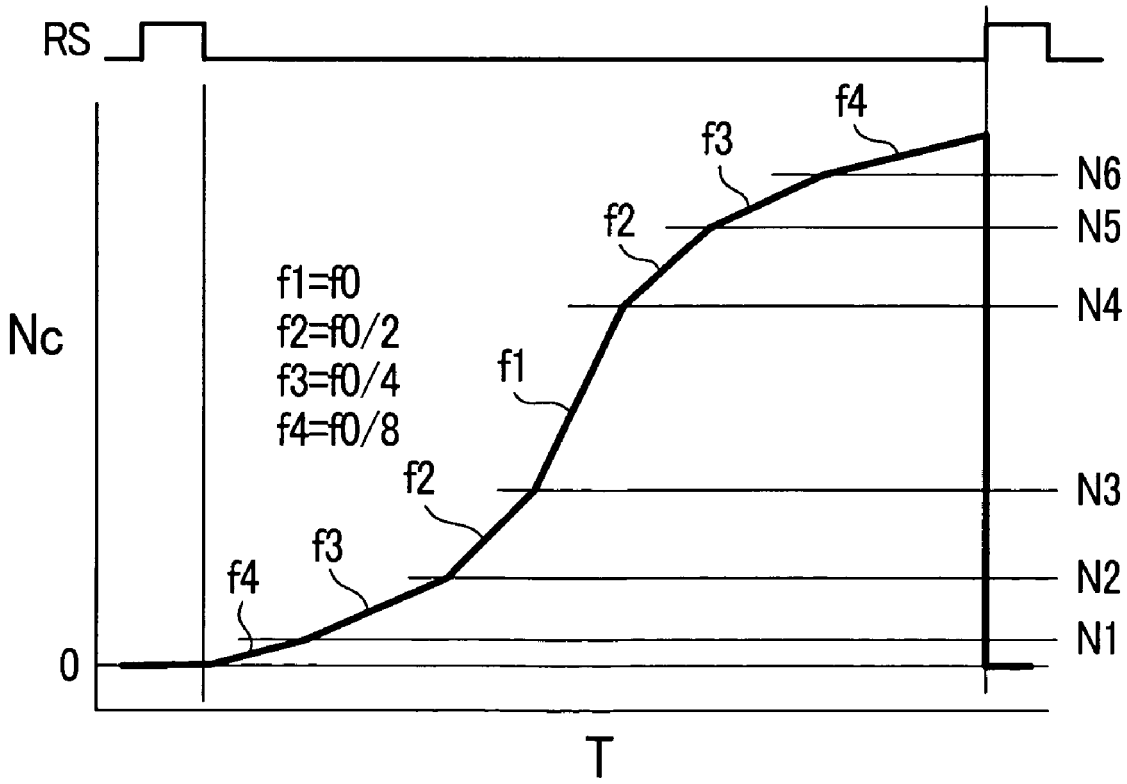
FIG. 4 is a table showing the relationship between a count value (Nc) of the counter shown in FIG. 2 and the frequency of an input signal (fin) inputted to the counter.
FIG. 5 is a graph showing a time response of a count value of the reference data generating circuit shown in FIG. 1.

FIG. 4 shows the relationship between the count value (Nc) of the counter 330 shown in FIG. 2 and the frequency of the input signal (fin) which is inputted to the counter 330. In response to the value (N1 to N6) stored in the register 340 and the count value (Nc) of the counter 330, the frequency of the input signal (fin) of the counter 330 is controlled as shown in FIG. 4.

FIG. 5 is a view showing time-sequential response of the count value of the reference data generating circuit 300. In FIG. 5, reference symbol T indicates time and reference symbol Nc indicates the count value. The counter 330 is reset in response to the initializing signal RS and, thereafter, the frequency of the input signal (fin) is changed, as shown in FIG. 4, in the sequence f4→f3→f2→f1→f2→f3→f4.

In this case, with respect to the count value (Nc) of the reference data generating circuit 300, the inclination is gentle when the frequency of the input signal (fin) is low and is steep when the frequency of the input signal (fin) is high. As a result, the time sequential response of the count value of the reference data generating circuit 300 exhibits the characteristic shown in FIG. 5.

Figure 3:
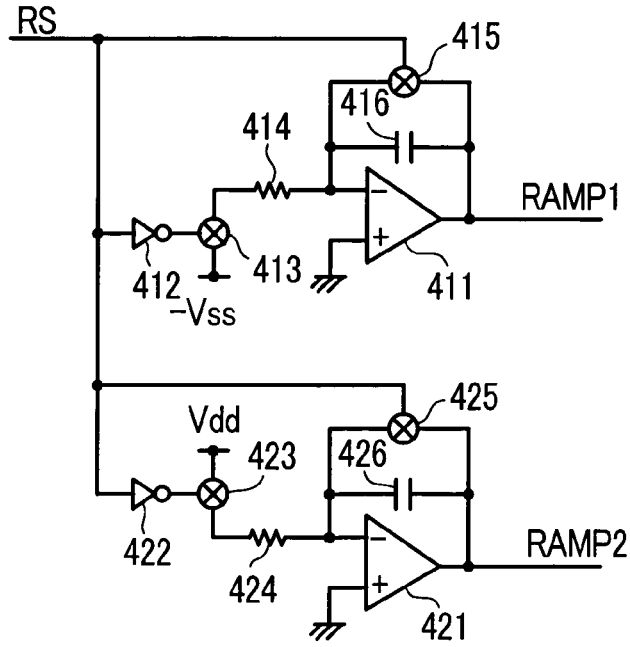
FIG. 3 is a schematic circuit diagram showing an example of the ramp voltage generating circuit shown in FIG. 1.

FIG. 3 is a circuit diagram showing the ramp voltage generating circuit 400 shown in FIG. 1.

The ramp voltage generating circuit 400 is, as shown in FIG. 3, constituted of two ramp generating circuits which generate a ramp voltage (RAMP1) of positive polarity and a ramp voltage (RAMP2) of negative polarity. The ramp generating circuit which generates the ramp voltage (RAMP1) is constituted of an operational amplifier 411, an inverter 412, switching elements (413, 415), a resistor 414 and a capacitor 416; while, the ramp generating circuit which generates the ramp voltage (RAMP2) is constituted of an operational amplifier 421, an inverter 422, switching elements (423, 425), a resistor 424 and a capacitor 426.

With respect to respective ramp generating circuits, when the initializing signal (RS) assumes the H level, the switching elements (413, 423) are turned off and the switching elements (415, 425) are turned on. In this state, the respective ramp generating circuits constitute voltage follower circuits, and, hence, the respective outputs assume a ground potential (GND). Next, when the initializing signal (RS) assumes the L level, the switching elements (413, 423) are turned on and the switching elements (415, 425) are turned off. Accordingly, the capacitors (416, 426) are charged, and, hence, the ramp voltage (RAMP1) rises along with a lapse of time and the ramp voltage (RAMP2) is decreased along with a lapse of time.

Figure 6:
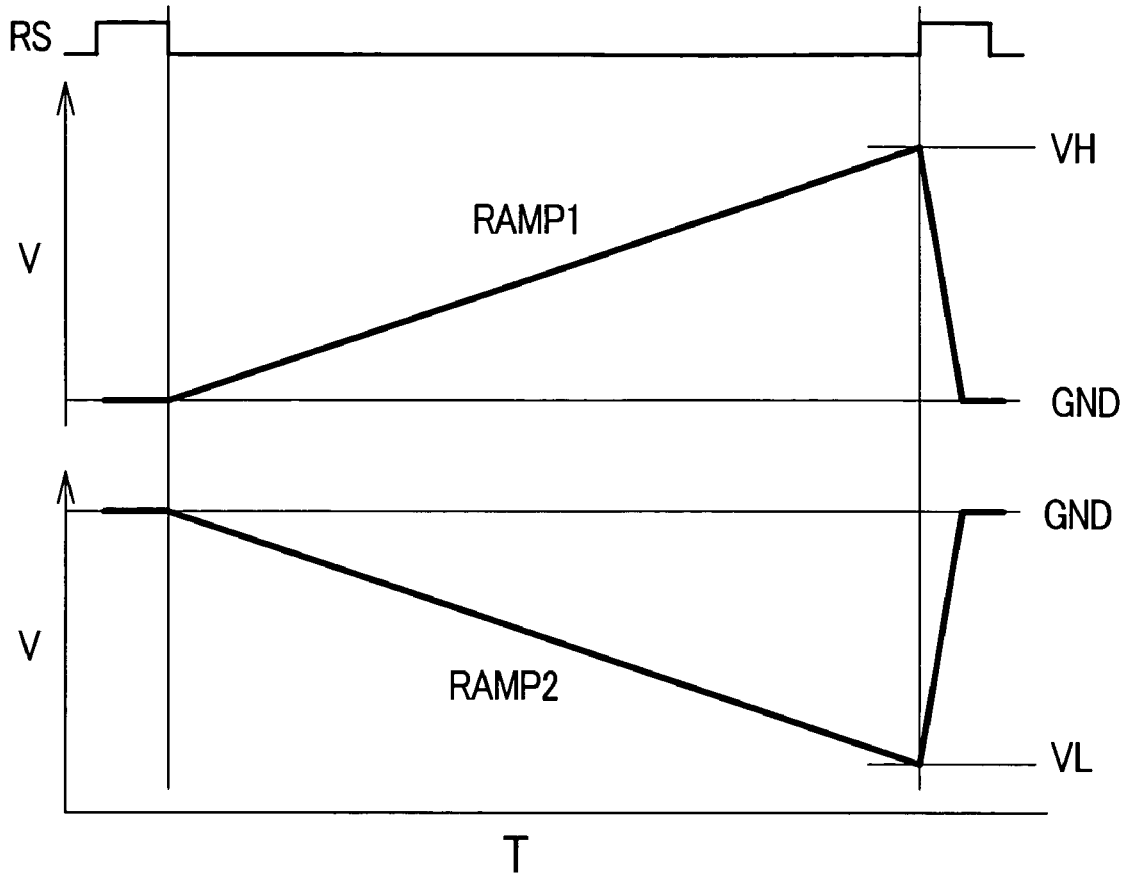
FIG. 6 is a signal diagram showing a time response of the ramp voltage generating circuit shown in FIG. 1.

FIG. 6 is a view showing the time-sequential response of the ramp voltage generating circuit 400. In FIG. 6, reference symbol T indicates time and reference symbol V indicates voltage.

In view of the time-sequential response of the count value (Nc) of the reference data generating circuit 300 shown in FIG. 5 and the time-sequential response of the ramp voltage generating circuit 400 shown in FIG. 6, the relationship between the count value (Nc) of the reference data generating circuit 300 and the output voltage (V) of the ramp voltage generating circuit 400 assumes an inverse function of the time-sequential response of the count value (Nc) of the reference data generating circuit 300. That is, the relationship of voltage and transmissivity (gamma characteristics) of the driven liquid crystal can be corrected by setting the time-sequential response of the count value of the reference data generating circuit 300 to a relationship similar to the gamma characteristics.

In this manner, according to this embodiment, by changing over the frequency of the input signal of the counter 330, which forms part of the reference data generating circuit 300, in response to the count value (Nc) of the reference data generating circuit 300, the gamma characteristics of the driven liquid crystal can be corrected.

According to this method, the ramp voltages (RAMP1, RAMP2) outputted from the ramp voltage generating circuit 400 may be always set to a fixed inclination, and, hence, even when a delay is present in the drain signal line D, since an absolute value of the error is fixed, the influence to on display quality can be reduced.

Figure 7:
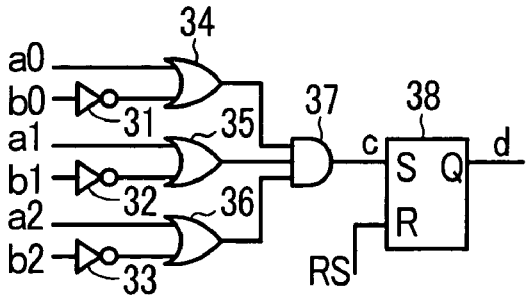
FIG. 7 is a schematic circuit diagram showing one example of the comparator used in the reference data generating circuit shown in FIG. 1.

FIG. 7 is a circuit diagram showing one example of the comparator 350 used in the reference data generating circuit 300. The circuit shown in FIG. 7 is of a comparator having a 3 bit input and is constituted of inverters (31, 32, 33), OR circuits (34, 45, 36), an AND circuit 37 and an SR flip-flop 38. In FIG. 7, reference symbols a0, a1, a2 indicate signals from the counter 330 and reference symbols b0, b1, b2 indicate signals from the register 340.

Figures 8, 9:
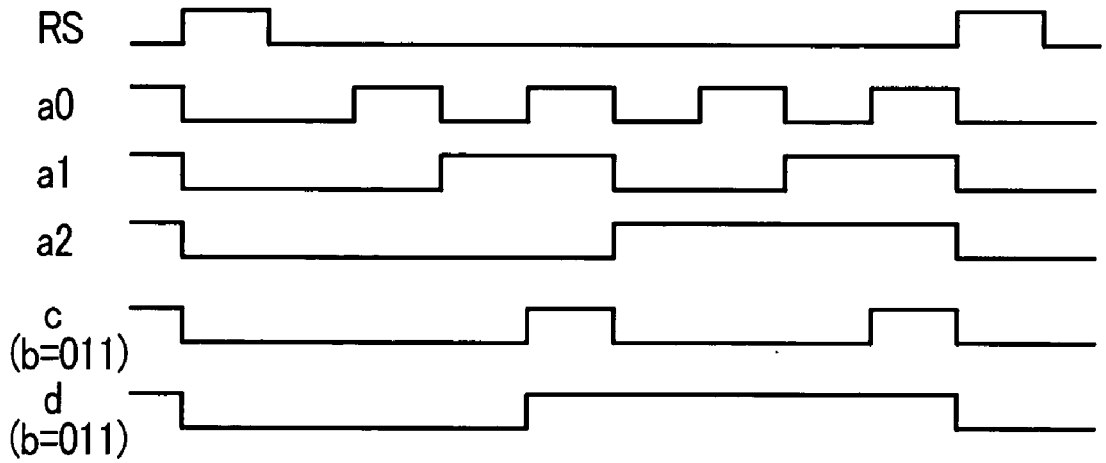
FIG. 8 is a truth table of the comparator circuit shown in FIG. 7.
FIG. 9 is a timing chart showing the operation when b=011 is set in the comparator circuit shown in FIG. 7.

A truth table of the comparator circuit shown in FIG. 7 is shown in FIG. 8. FIG. 8 indicates an output c of the AND circuit 37. When the count value of the counter 330 is increased from 0, the output c changes 0 to 1 at a point of time that the value of b becomes equal to the count value of the counter 330. By inputting this output c to the SR flip-flop 38, the output d assumes the H level when the relationship $a \geqq b$ is satisfied.

FIG. 9 is a timing chart which shows when the signal b is set as b=011 in the comparator circuit shown in FIG. 7. The output c assumes the H level when the signal is a=011 and a=111, while the output d of the SR flip-flop 38 assumes the H level when the signals a, b assume the relationship $a \geqq b$.

Figure 10:
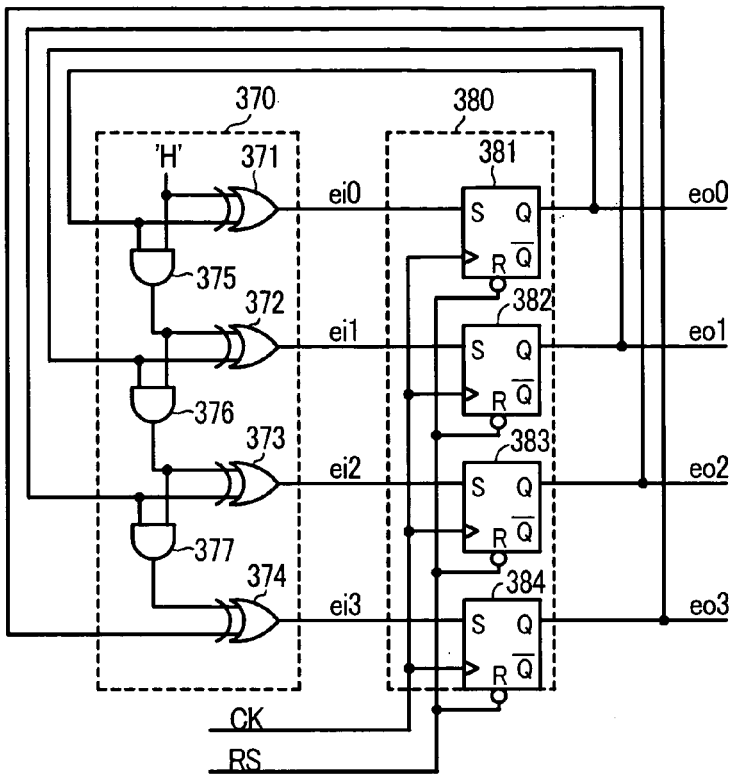
FIG. 10 is a schematic circuit diagram showing one example of the counter shown in FIG. 2.

FIG. 10 is a circuit diagram showing one example of the counter 330 shown in FIG. 2. The circuit shown in FIG. 10 is a 4 bit counter and is constituted of a latch circuit 380 and an incrementer 370.

The latch circuit 380 is constituted of D-type flip-flops (381 to 384), and it is operated in response to the clock (CK), the initializing signal (RS) and inputs (ei0 to ei3), latches the inputs (ei0 to ei3) at the timing of the clock (CK), and generates the outputs (eo0 to eo3). The incrementer 370 is constituted of AND circuits (375 to 377) and EOR circuits (exclusive "or" circuit) (371 to 374) and an output of the incrementer 370 is inputted to the latch circuit 380 and "1" is added to the latch circuit 380.

Due to such a constitution, it is possible to realize a synchronous-type counter 330 which can add "1" to the output of the latch circuit 380 at the timing of the clock (CK). The counter 330 shown in FIG. 10 is also applicable to the frequency dividing circuit 310.

Figure 11:
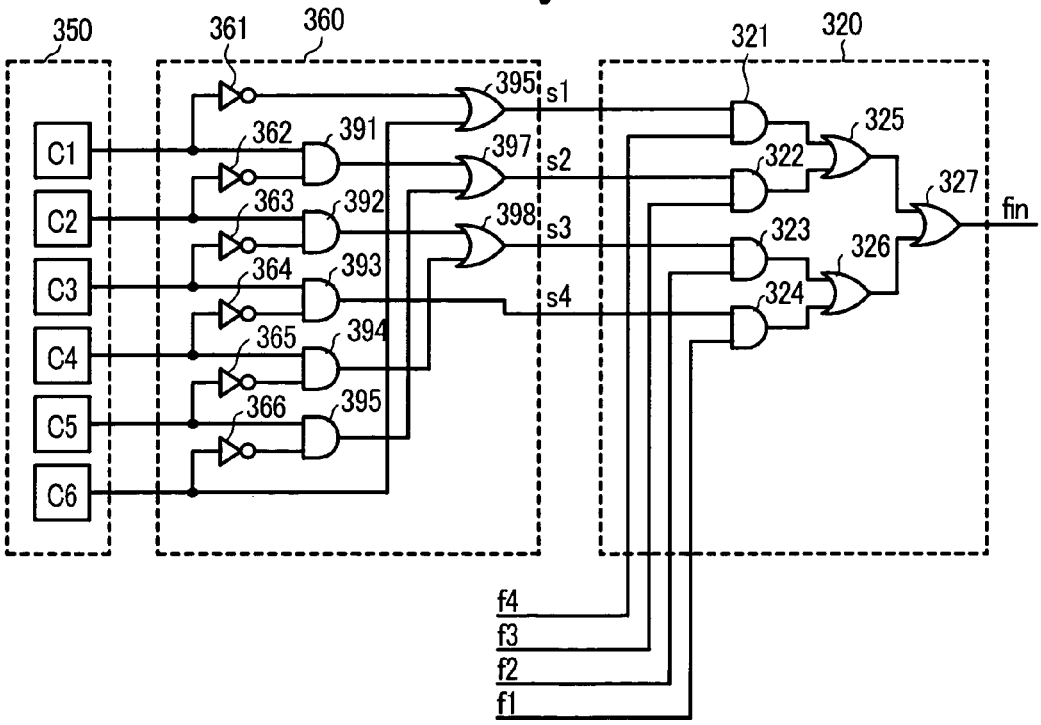
FIG. 11 is a schematic circuit diagram showing one example of the control circuit and selector shown in FIG. 2.

FIG. 11 is a circuit diagram showing one example of the control circuit 360 and the selector 320 shown in FIG. 2.

The control circuit 360 shown in FIG. 11 is constituted of inverters (361 to 366), AND circuits (391 to 395) and OR circuits (396 to 398), and it receives the output of the comparator 350 as an input thereof and outputs selector signals (s1 to s4). The selector 320 is constituted of AND circuits (321 to 324) and OR circuits (325 to 327), and it selects one of the output signals (f1 to f4) of the frequency dividing circuit in response to the selector signals (s1 to s4) and outputs the input signal (fin).

As mentioned previously, the output of the comparator 350 assumes the H level in the order of C1→C2→C3→C4→C5→C6. Assuming that the outputs (C1 to C6) of the comparator 350 are set to the L level, the selector signal (s1) assumes the H level, and, hence, due to the AND circuit 321, the frequency dividing signal having the frequency of f4 is selected as the input signal (fin).

Next, when the output (c1) of the comparator 350 assumes the H level, due to the AND circuit 391, the selector signal (s2) assumes the H level, and, hence, due to the AND circuit 322, the frequency dividing signal having the frequency of f3 is selected as the input signal (fin).

Hereinafter, in the same manner, the frequency dividing signal selected by the selector 320 is changed in the order of f4→f3→f2→f1→f2→f3→f4.

Figure 12:
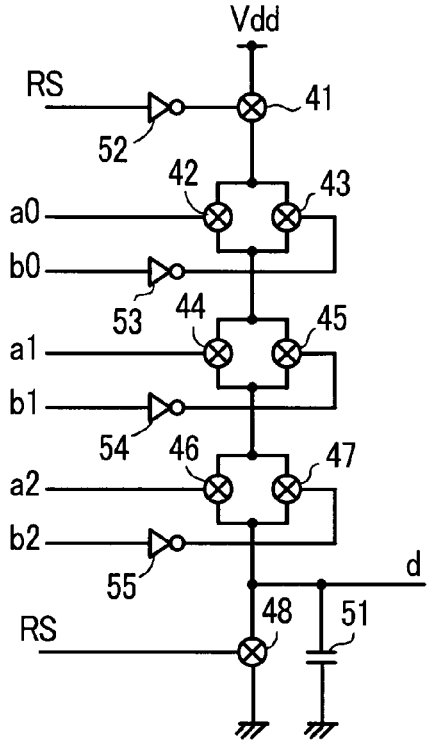
FIG. 12 is a schematic circuit diagram showing an example of the comparator shown in FIG. 2 constituted as a dynamic circuit.

FIG. 12 is a circuit diagram showing the circuit constitution when the comparator 350 shown in FIG. 2 is constituted as a dynamic circuit. The circuit shown in FIG. 12 is constituted of switching elements (41 to 48), inverters (52 to 55) and a capacitor 51.

When the initializing signal (RS) assumes the H level, the switching element 41 is turned off and the switching element 48 is turned on, so that the output d assumes the L level. Next, when the initializing signal (RS) assumes the L level, the switching element 41 is turned on and the switching element 48 is turned off, and, hence, an output d is controlled based on a switching element logic provided by the switching elements (42 to 47).

In the switching element logic, the parallel connection constitutes an OR operation and the serial connection constitutes an AND operation, and, hence, the constitution of the switching elements (42 to 47) are equivalent to the constitution of the circuit shown in FIG. 7.

Figure 13:
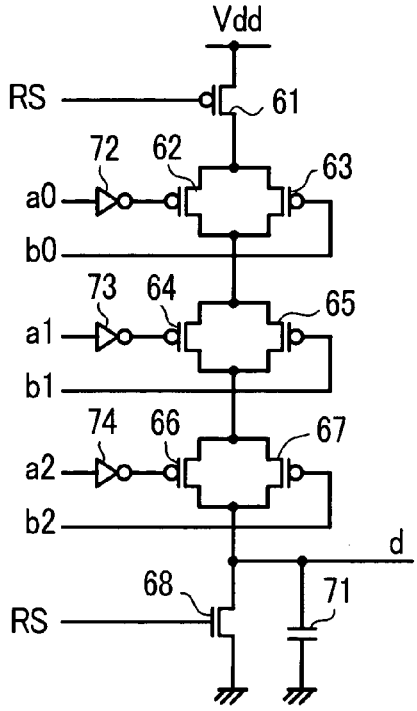
FIG. 13 is a schematic circuit diagram showing an example of the dynamic circuit shown in FIG. 12 constituted of thin film transistors.
Figure 14:
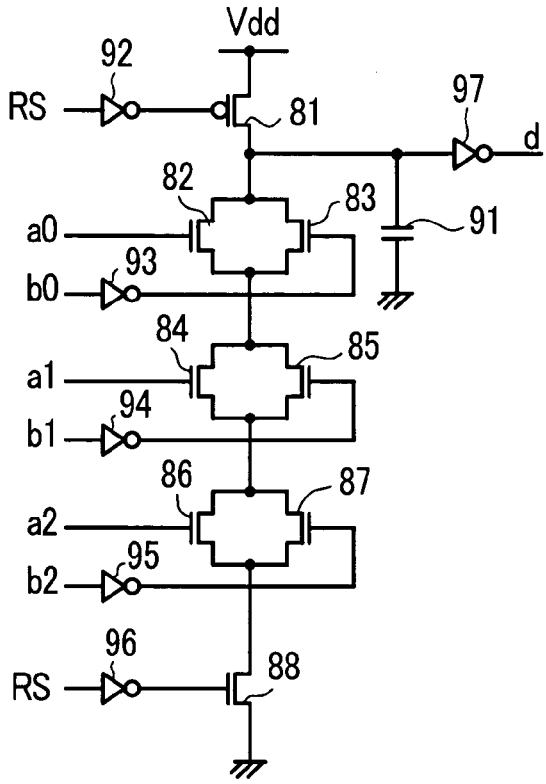
FIG. 14 is a schematic circuit diagram showing an example of the dynamic circuit shown in FIG. 12 constituted of thin film transistors.

The circuit constitution of the dynamic circuit shown in FIG. 12, when the dynamic circuit is constituted of thin film transistors, is shown in FIG. 13 and FIG. 14. The circuit shown in FIG. 13 constitutes the switching element logic using P-type MOS transistors (hereinafter referred to as PMOS) and the circuit shown in FIG. 14 constitutes the switching element logic using N-type MOS transistors (hereinafter referred to as NMOS).

Figure 15:
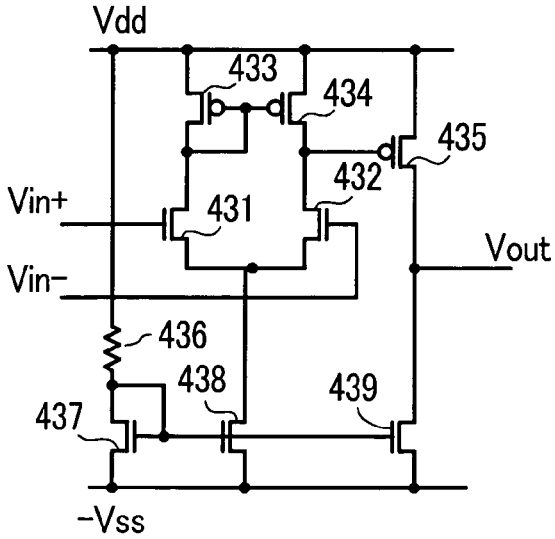
FIG. 15 is a schematic circuit diagram showing an example of the operational amplifier, which constitutes the ramp voltage generating circuit shown in FIG. 3, constituted of thin film transistors.
Figure 16:
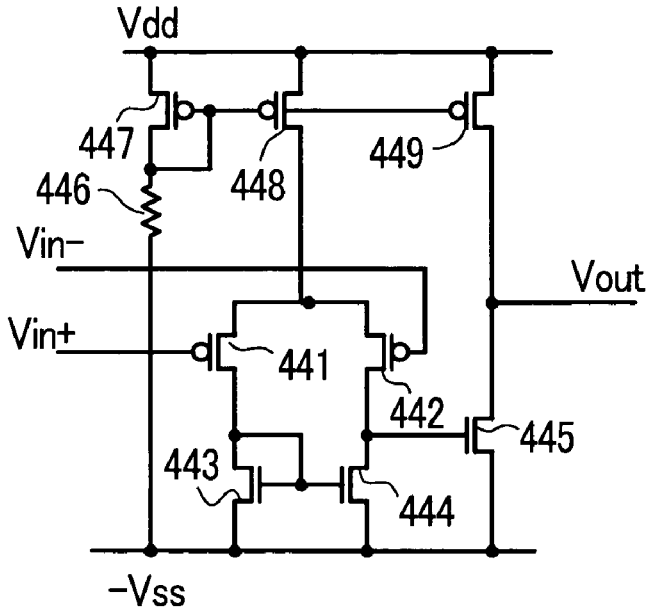
FIG. 16 is a schematic circuit diagram showing an example of the operational amplifier, which constitutes the ramp voltage generating circuit shown in FIG. 3, constituted of thin film transistors.
Figure 18:
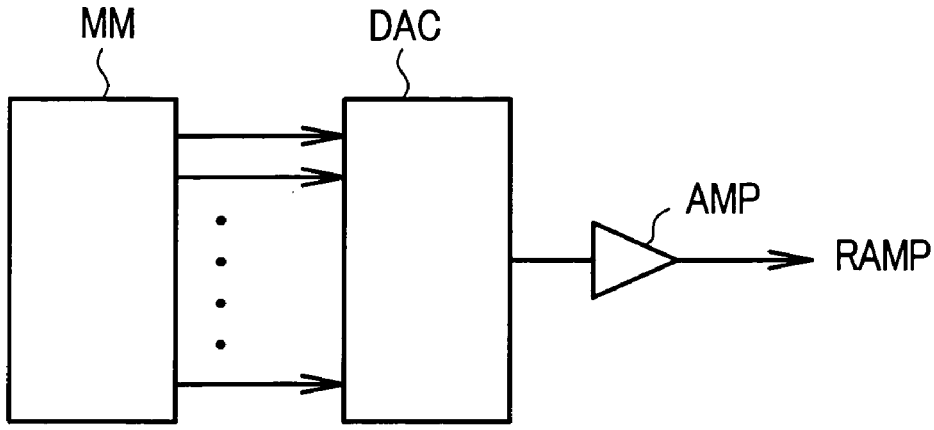
FIG. 18 Prior Art
FIG. 18 is a block diagram showing one example of a circuit for performing gamma correction.

FIG. 15 and FIG. 16 are circuit diagrams showing the circuit constitution when the operational amplifiers (411, 421) which constitute the ramp voltage generating circuit 400 shown in FIG. 3 are constituted of thin film transistors. The circuit shown in FIG. 15 is the circuit of the operational amplifier used in the ramp generating circuit which generates the ramp voltage (RAMP1) of positive polarity, while the circuit shown in FIG. 16 is the circuit of the operational amplifier used in the ramp generating circuit which generates the ramp voltage (RAMP2) of negative polarity.

In the circuit shown in FIG. 15, the output transistor 435 is constituted of a PMOS transistor having the source connected to ground. Due to such a constitution, at the time of generating the ramp voltage (RAMP1) of positive polarity, it is possible to ensure a current (source current) in the outputting direction from a required output terminal, and, at the same time, it is possible to raise the output voltage to a voltage in the vicinity of the power source voltage.

In the circuit shown in FIG. 16, the output transistor 445 is constituted of a NMOS transistor having its source connected to the ground. Due to such a constitution, at the time of generating the ramp voltage (RAMP2) of negative polarity, it is possible to ensure a current (sink current) in the inputting direction at the required output terminal, and, at the same time, it is possible to lower the output voltage to a voltage in the vicinity of a negative power source voltage.

Embodiment 2

Figure 17:
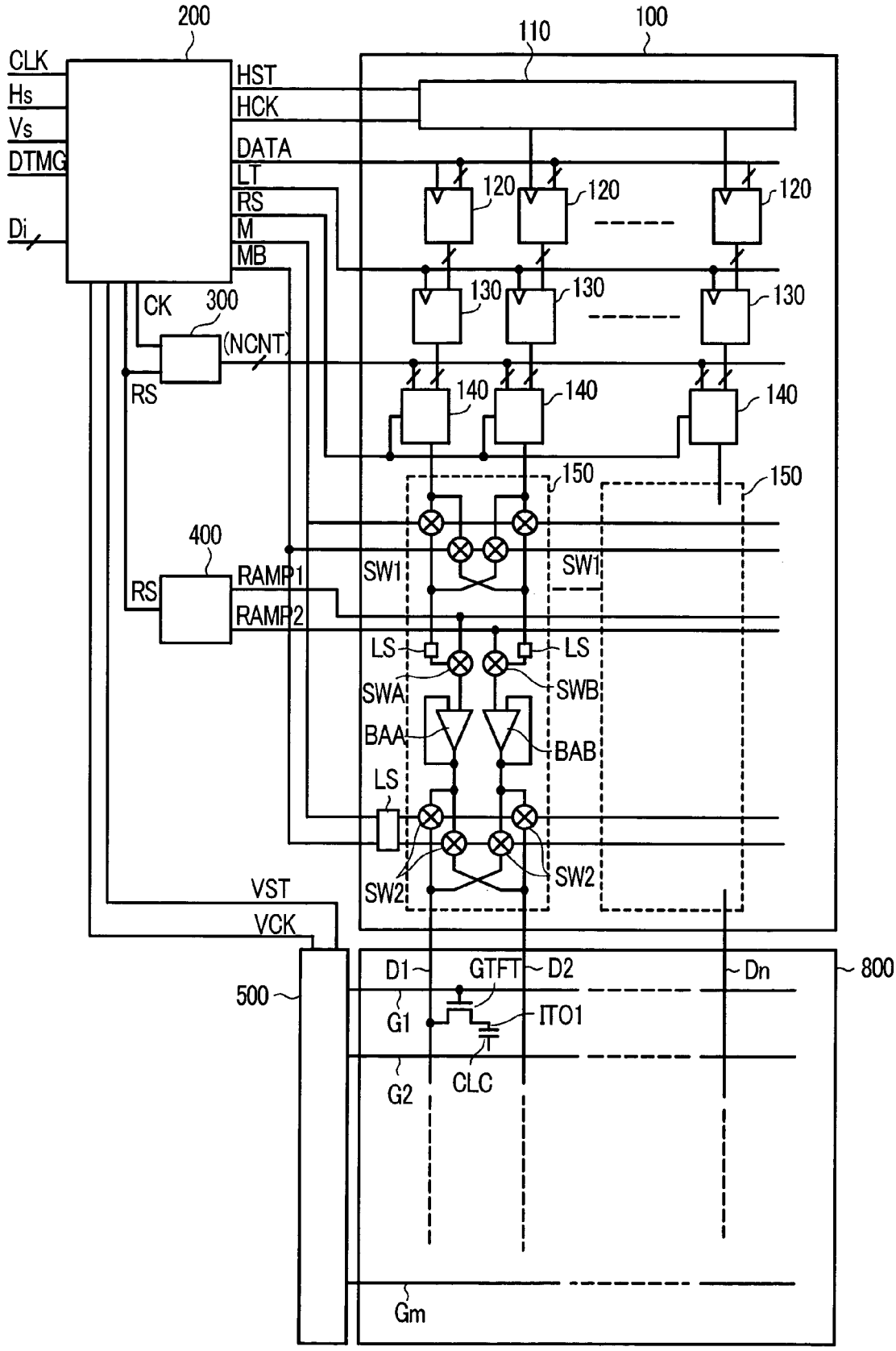
FIG. 17 is a schematic diagram showing an example of a liquid crystal display device according to the embodiment 2 of the present invention.

FIG. 17 is a schematic diagram showing the constitution of a liquid crystal display device according to embodiment 2 of the present invention.

The feature which makes this embodiment 2 different from the previously-mentioned embodiment 1 lies in the constitution of the sample holding circuit 150.

In this embodiment, in the sample holding circuit 150, a buffer amplifier (BAA) which amplifies the ramp voltage (RAMP1) of positive polarity and a buffer amplifier (BAB) which amplifies the ramp voltage (RAMP2) of negative polarity are provided so as to drive the drain signal lines D using the buffer amplifiers. As a result, a fluctuation of the load of the ramp voltage generating circuit 400 attributed to display images can be suppressed, and, hence, images of high quality can be displayed.

Here, the buffer amplifier (BAA) and the buffer amplifier (BAB) are provided for every two neighboring drain signal lines (for example, the drain signal line (D1) and the drain signal line (D2) shown in FIG. 17), wherein two drain signal lines use the buffer amplifier (BAA) and the buffer amplifier (BAB) in common. Accordingly, in this embodiment, the outputs of two comparators 140, which correspond to two neighboring drain signal lines, are inputted to the sample holding circuit 150.

Then, due to the operation of switching elements (SW1), which are controlled in response to the alternating signals (M, MB), an output of one comparator 140 is outputted to a switching element (SWA) which samples the ramp voltage (RAMP1) of positive polarity to or a switching element (SWB) which samples the ramp voltage (RAMP2) of negative polarity. Simultaneously, an output of another comparator 140 is outputted to the switching element (SWB) or the switching element (SWA).

Further, due to the operation of switching elements (SW2), which are controlled in response to the alternating signals (M, MB), an output of the buffer amplifier (BAA) which amplifies the ramp voltage (RAMP1) of positive polarity, is inputted to one drain signal line; or another drain signal line and, at the same time, an output of the buffer amplifier (BAB), which amplifies the ramp voltage (RAMP2) of negative polarity, is inputted to the other drain signal line or the one drain signal line.

For example, with respect to the case shown in FIG. 17, when the alternating signal (M) assumes the H level and the alternating signal (MB) assumes the L level, the output of the comparator 140 corresponding to the drain signal line (D1) is inputted to the switching element (SWA) and the output of the comparator 140 corresponding to the drain signal line (D2) is inputted to the switching element (SWB). Further, the output voltage of the buffer amplifier (BAA) is inputted to the drain signal line (D1) and the output voltage of the buffer amplifier (BAB) is inputted to the drain signal line (D2).

Further, when the alternating signal (M) assumes the L level and the alternating signal (MB) assumes the H level, the output of the comparator 140 corresponding to the drain signal line (D1) is inputted to the switching element (SWB) and the output of the comparator 140 corresponding to the drain signal line (D2) is inputted to the switching element (SWA). Further, the output voltage of the buffer amplifier (BAB) is inputted to the drain signal line (D1) and the output voltage of the buffer amplifier (BAA) is inputted to the drain signal line (D2).

Accordingly, the polarity of the video signal supplied to the drain signal lines D can be inverted for every horizontal scanning line between the neighboring drain signal lines.

As has been explained heretofore, gamma correction of the video signal voltage applied to the liquid crystal is performed using the reference data generating circuit 300, and, hence, the ramp voltage outputted from the ramp voltage generating circuit 400 can have a fixed inclination. Thus, even when a delay is present in the voltage waveform of the ramp voltage on the drain signal line D, it is possible to set the error to a fixed value, whereby the present invention is applicable to a drain driver of high accuracy.

Further, the reference data generating circuit 300 can be realized using a logic circuit, and, hence, the reference data generating circuit 300 can be easily formed on the same substrate as the display part 800. Further, since the data used for gamma correction is stored in a register, it is possible to set the data particularly for every product or for every panel individually.

Further, since the ramp voltages (RAMP1, RAMP2) which are outputted from the ramp voltage generating circuit 400 can be held at the positive polarity and the negative polarity, respectively, without changing the polarity, it is possible to simplify the circuit, and, at the same time, the ramp voltage generating circuit 400 can be formed on the substrate on which the display part 800 is formed.

In this manner, according to the liquid crystal display device of this embodiment, by performing gamma correction individually, or performing temperature compensation which changes the correction value in response to temperature, it is possible to realize a display of high quality.

Further, by forming the drain driver and the peripheral circuit on the substrate on which the display part 800 is formed, the number of parts and the number of connection terminals can be reduced, and, hence, a display having high reliability can be realized.

Further, since the alternating operation is performed by the sample holding circuit 150, the ramp voltages (RAMP1, RAMP2) which are outputted from the ramp voltage generating circuit 400 can be held at the positive polarity and the negative polarity respectively, without changing the polarity, whereby the voltage amplitude can be decreased and the power consumption can be reduced.

Further, the output impedance of the ramp generating circuit 400 can be reduced, and, hence, the delay time can be shortened whereby display images of high quality can be obtained.

Here, although the present invention has been explained in conjunction with various embodiments, which are applied to a liquid crystal display module, it is needless to say that the present invention is not limited to these embodiments, but is applicable to other display devices, such as an EL display device.

Although the present invention has been specifically described based on certain embodiments, it is needless to say that the present invention is not limited to these embodiments and that various modifications are conceivable without departing from the gist of the present invention.

A brief explanation of the advantageous effects obtained by typical aspects of the invention disclosed in this specification is provided, as follows.

(1) According to the present invention, the data for gamma correction can be stored in a register, and, hence, it is possible to set the data for every product or for every panel individually; whereby, by performing gamma correction individually or by performing temperature compensation which changes the correction value in response to temperature at the time of shipping, it is possible to realize a display of high quality.

(2) According to the present invention, since the driving circuit can be formed on the substrate on which the display part is formed, it is possible to realize a highly reliable display, while reducing the number of parts and the number of connection terminals.

(3) According to the present invention, the voltage amplitude of the ramp voltage generating circuit can be decreased, and, hence, the power consumption can be reduced; and, at the same time, the output impedance of the ramp generating circuit can be reduced and the delay time can be shortened, whereby display images of high quality can be obtained.

What is claimed is:

1. A display device comprising:

a display part having a plurality of pixels;

a plurality of video signal lines which apply a video signal voltage to the plurality of pixels; and a drive circuit which supplies the video signal voltage to the plurality of video signal lines, wherein the drive circuit includes:

a) a storage circuit which stores display data inputted from the outside;

b) a reference data generating circuit which generates reference data;

c) a ramp voltage generating circuit which generates a ramp voltage;

d) a plurality of comparing circuits which compare the display data stored in the storage circuit and the reference data generated by the reference data generating circuit, and e) a plurality of sampling circuits which sample the ramp voltage generated by the ramp voltage generating circuit based on a result of comparison of the comparing circuits and output the sampled ramp voltage as a video signal voltage to respective video signal lines, wherein the reference data generated by the reference data generating circuit is changed non-linearly with respect to time, and wherein the reference data generating circuit includes:

a selection circuit to which a plurality of clocks which have different frequencies from each other are inputted and selects one clock out of the plurality of clocks in response to a selection control signal;

a counter which counts the clock selected by the selection circuit and outputs the number of counts as the reference data; and a control part which transmits the selection control signal which indicates the clock to be selected by the selection circuit in response to a preset number of counts and the number of counts of the counter.

2. A display device comprising:

a display part having a plurality of pixels;

a plurality of video signal lines which apply a video signal voltage to the plurality of pixels; and a drive circuit which supplies the video signal voltage to the plurality of video signal lines, wherein the drive circuit includes:

a) a storage circuit which stores display data inputted from the outside;

b) a reference data generating circuit which generates reference data;

c) a ramp voltage generating circuit which generates a ramp voltage of positive polarity and a ramp voltage of negative polarity,;

d) a plurality of comparing circuits which compare the display data stored in the storage circuit and the reference data generated by the reference data generating circuit, and e) a plurality of sampling circuits which sample the ramp voltage of positive polarity or the ramp voltage of negative polarity generated by the ramp voltage generating circuit in response to an alternating signal inputted from the outside and the result of comparison of the comparing circuits and output the sampled ramp voltage to respective video signal lines as a video signal voltage, wherein the reference data generated by the reference data generating circuit is changed non-linearly with respect to time, and wherein the reference data generating circuit includes:

a selection circuit to which a plurality of clocks which have different frequencies from each other are inputted and selects one clock out of the plurality of clocks in response to a selection control signal;

a counter which counts clocks the clock selected by the selection circuit and outputs the number of counts as the reference data; and a control part which transmits the selection control signal which indicates the clocks clock to be selected by the selection circuit in response to a preset number of counts and the number of counts of the counter.

3. A display device comprising:

a display part having a plurality of pixels;

a plurality of video signal lines which apply a video signal voltage to the plurality of pixels; and a drive circuit which supplies the video signal voltage to the plurality of video signal lines, wherein the drive circuit includes:

a) a storage circuit which stores display data inputted from the outside;

b) a reference data generating circuit which generates reference data;

c) a ramp voltage generating circuit which generates a ramp voltage of positive polarity and a ramp voltage of negative polarity;

d) a plurality of comparing circuits which compare the display data stored in the storage circuit and the reference data generated, by the reference data generating circuit, and e) a sampling circuit to which a comparing result of the two neighboring comparing circuits is inputted and outputs video signal voltages of polarities which are opposite to each other to the neighboring video signal lines, wherein the sampling circuit includes i) a first sampling circuit which samples the ramp voltage of positive polarity generated by the ramp voltage generating circuit in response to an inputted result of comparison of one comparing circuit out of two comparing circuits, ii) a second sampling circuit which samples the ramp voltage of negative polarity generated by the ramp voltage generating circuit in response to an inputted result of comparison of another comparing circuit out of two comparing circuits, iii) a first switching circuit which inputs the inputted result of comparison of one of comparing circuit out of two comparing circuits to either the first sampling circuit or the second sampling circuit and the inputted result of comparison of another comparing circuit out of two comparing circuits into either the second sampling circuit or the first sampling circuit in response to an alternating signal inputted from the outside, and iv) a second switching circuit which outputs the ramp voltage of positive polarity sampled by the first sampling circuit to one video signal line or another video signal line out of neighboring video signal lines as a video signal voltage, or outputs the ramp voltage of negative polarity which is sampled by the second sampling circuit to another video signal line or one video signal line out of the neighboring video signal lines as a video signal voltage in synchronism with the changeover at the first switching circuit in response to the alternating signal.

4. A display device according to claim 3, wherein a buffer amplifying circuit which amplifies the sampled ramp voltage is provided in a stage prior to the second switching circuit.

5. A display device according to claim 3 or claim 4, wherein the reference data generated by the reference data generating circuit changes non-linearly with respect to time.

6. A display device according to any one of claim 1 to claim 4, wherein the drive circuit is integrally formed on a substrate on which the display part is formed using thin film transistors.

7. A display device according to claim 3, wherein the reference data generating circuit includes:

a selection circuit to which a plurality of clocks which have different frequencies from each other are inputted and selects one clock out of the plurality of clocks in response to a selection control signal;

a counter which counts the clock selected by the selection circuit and outputs the number of counts as the reference data; and a control part which transmits the selection control signal which indicates the clock to be selected by the selection circuit in response to a preset number of counts and the number of counts of the counter.

8. A display device according to claim 1, claim 2 or claim 7, wherein the control part includes:

a plurality of registers which store the preset number of counts;

a plurality of comparators which compare the number of counts stored in respective registers and the number of counts of the counter;

a control circuit which generates the selection control signals in response to a result of a comparison at the plurality of comparators.

* * * * *